United States Patent [19]

Cantillo

[11] 4,319,367

[45] Mar. 16, 1982

[54] BATHROOM SPACE EXPANDER

[76] Inventor: Humberto Cantillo, 11431 SW. 191st St., Miami, Fla. 33157

[21] Appl. No.: 130,866

[22] Filed: Mar. 17, 1980

[51] Int. Cl.[3] ..... E03D 17/00; E03D 1/012; A47K 1/08; A47B 57/00

[52] U.S. Cl. ..... 4/353; 4/630; 4/661; 108/63; 108/102; 248/231; 312/237

[58] Field of Search ..... 4/353, 551, 571, 572, 4/578, 584, 586, 587, 630, 646, 654, 656, 658, 659, 661, 191; 312/237, 241, 242, 228; 108/27, 50, 63, 69, 90, 93, 102; 248/231

[56] References Cited

U.S. PATENT DOCUMENTS

| | | | |
|---|---|---|---|
| 1,976,034 | 10/1934 | Poetsch | 108/93 X |
| 2,099,932 | 11/1937 | Isaacson | 4/353 |
| 2,170,776 | 8/1939 | Goepel | 4/353 |
| 2,260,915 | 10/1941 | Mummery | 4/353 X |
| 2,729,905 | 1/1956 | Crozier | 108/63 |
| 3,179,071 | 4/1965 | Johnston | 312/237 X |
| 3,221,677 | 12/1965 | Kerr | 108/102 |
| 3,606,509 | 9/1971 | Bennett | 312/242 |
| 3,785,604 | 1/1974 | Steck | 248/231 |
| 3,943,859 | 3/1976 | Boone | 108/50 |
| 3,993,376 | 11/1976 | Meldahl | 4/658 X |
| 4,034,518 | 7/1977 | Trecker | 312/241 X |
| 4,123,809 | 11/1978 | Pugh | 4/659 |
| 4,155,312 | 5/1979 | Thorkildson | 108/102 X |

*Primary Examiner*—Stuart S. Levy
*Attorney, Agent, or Firm*—John Cyril Malloy

[57] ABSTRACT

A bathroom space expander including a first member removably but securely connected to a toilet tank cover, a second member swingably connected to the first member, hinge means connecting the members to a first closed storage position and a second open operational position. The second member including expandible side walls and a downwardly extending support member resting upon a toilet seat cover for keeping the second member in the horizontal operational position for use while folding clothes, diapering a baby or the like.

6 Claims, 6 Drawing Figures

BATHROOM SPACE EXPANDER

BACKGROUND OF THE INVENTION

1. Field of Invention

This invention relates generally to a support device, and, more particularly, to a multi-element structure for efficient utilization of space in a bathroom designed for two position use for operation and storage.

In the past, there have been many support devices and many space saving devices. See for example, U.S. Pat. Nos. 1,976,034, 3,179,071 and 3,943,859. The applicant has designed a device wherein the narrow confines of a bathroom having limited space are efficiently utilized so that a user may for instance wash an infant in a sink and diaper it on the invention.

Additionally, the invention may be used for folding clothes or in ways that ordinary support devices may be used, cerating efficient spatial use of the limited areas, like a bathroom.

2. Summary of the Invention

This invention comprises a two-member structure wherein the members are swingable in relation to each other and held together by hinge means. A strap securely fastens the first member to a toilet tank, and more particularly over the toilet tank cover; the second member swingable with respect thereto having a first a storage and second operational positions. A support means supports the second member in the operational position for keeping the second member horizontal. The support means may be fixed or removable with respect to the second member depending on the user's needs. Additionally, the second member may include expandable side walls creating additional support areas for the user and maximizing spacial efficiency.

In accordance with these and other objects of the invention, which will become more apparent hereinafter, the instant invention will now be described with reference to the accompanying drawings in which:

DESCRIPTION OF THE PREFERRED EMBODIMENT

Figure 1:
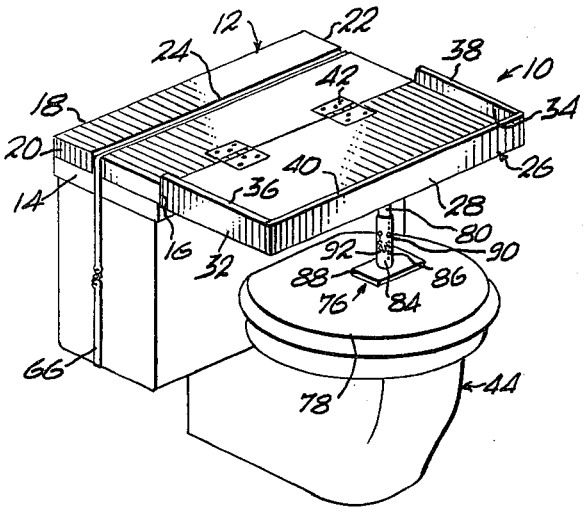
FIG. 1 is a perspective view of the invention showing the structure in a open operational position.

Referring to the drawings wherein like reference characters designate like or corresponding parts throughout the several views and referring particularly to FIG. 1, there is shown the invention, a bathroom space expander, generally designated by the numeral 10, having a first member 12 sized and shaped for compatible engagement with the toilet tank cover 14. It will be noticed generally in FIG. 1 that the first member 12 is generally rectangular having front, back and side edges 16, 18, 20 and 22 respectively.

As can be seen in FIG. 1, the first member 12 includes a recess 24 centrally located between the front and rear edges 16 and 18 respectively, and the recess 24 spanning the side edges 20 and 22. As will be appreciated more fully hereinafter, the recess serves as an element of the means for securing the first member 12 to the toilet tank.

Again, referring to FIG. 1, there is shown a second member generally denoted by the numeral 26 having a front fixed wall 28 and expandable side walls 32 and 34. The second member is shaped and sized similar to the first member, with the addition of the front and side walls.

The side and front walls 28, 32 and 34 respectively include upwardly projecting side and rear wall portions 36, 38 and 40, respectively, in the position of FIG. 1.

Figure 2:
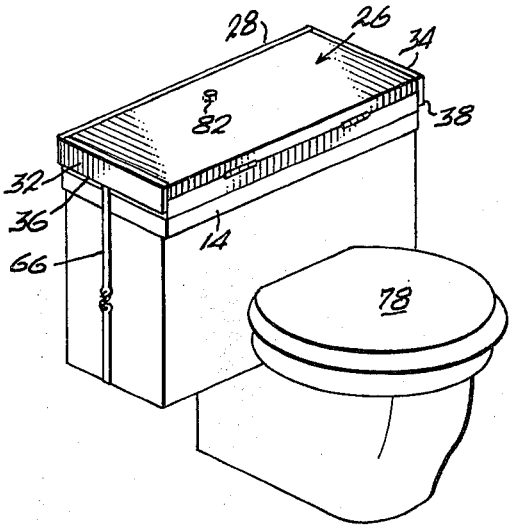
FIG. 2 is a perspective view showing the invention in a second closed and stored position.

The first and second members are swingably connected by hinge means 42. Thereby, the members may be rotated into a closed or stored position as shown in FIG. 2. In that position the side walls 36, 38 and 40 overhang the side and rear edges of the first member 12 and are then adjacent the toilet tank cover 14, thus making it possible for a user to use the toilet 44 conveniently, even when the invention is connected to the toilet tank.

Figure 3:
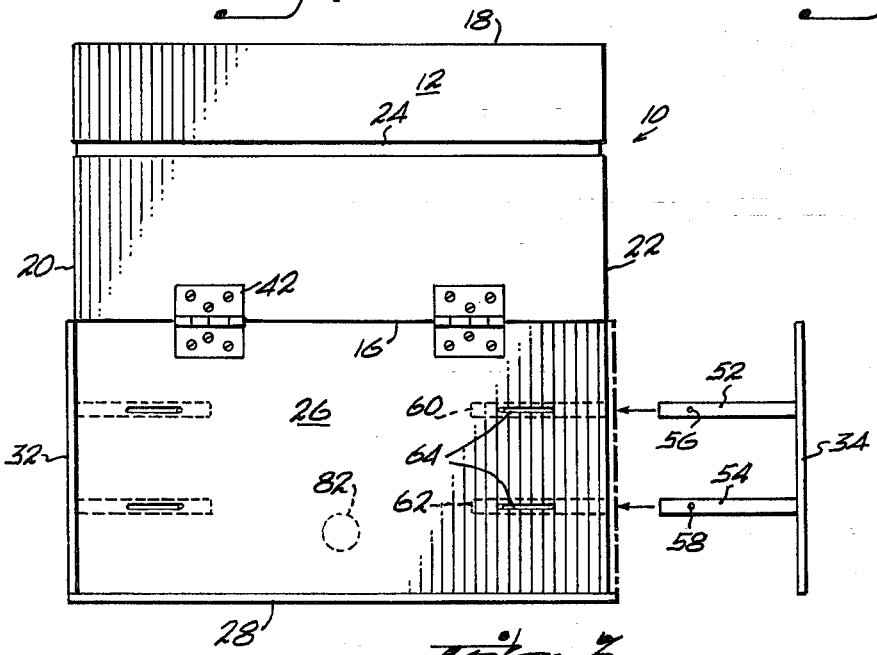
FIG. 3 is an enlarged plan view of the invention.
Figure 4:
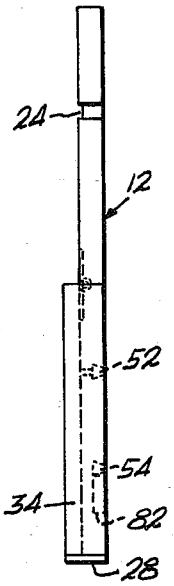
FIG. 4 is a side elevational plan view of FIG. 3.
Figure 5:
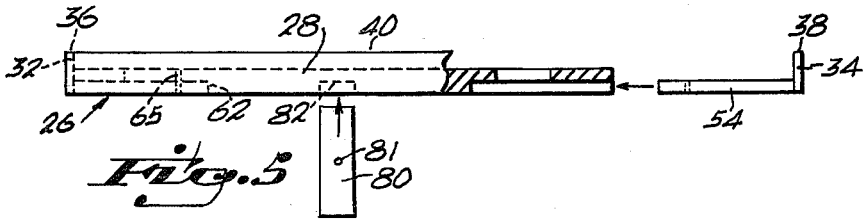
FIG. 5 is a front elevational view of FIG. 3.

Referring particularly to FIG. 3, the enlarged plan view illustrates the expandable side walls denoted by the numerals 32, 34. The side walls 32, 34 comprise laterally extending members having a predetermined length, approximately the width of the second member 26, and two inwardly extending elongated members 52 and 54, including upwardly extending through holes 56.

The second member 26 is adapted for receipt of the elongated slidable members 52, 54 in elongated recesses 60 and 62, having vertical slots 64 of predetermined lengths for reception of keeper pins as at 65 through slots 64 into holes 58, 60 to control the expandability of side walls 32, 34.

It will be readily appreciated that in certain confines the invention need not include two expandable side walls such as 32, 34, but may include only one expandable slidable side wall, at the convenience of the user.

Figure 6:
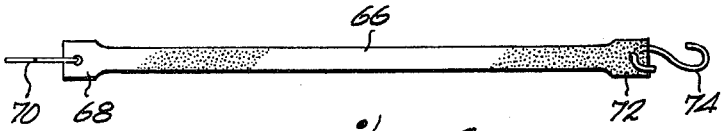
FIG. 6 is a front elevatonal view of the means for securing the invention to the toilet tank.

Referring particularly to FIG. 6, there is shown a flexible strap means 66 having a predetermined length sufficient to wrap around the toilet tank and first member as shown in FIG. 1, with a first end 68 having a first hook connection 70 and a second end 72 having a second hook 74 for compatible interengagement with the hook 70.

Referring to FIG. 1, adjustable support means 76 are provided to position the member 26 relative to the toilet set cover 78. A first stud portion 80, including a single through hole 81, is adapted for reception in a hole 82 in the bottom of member 26 and a second tubular member 84 includes a plurality of holes 86 along its length, for selective alignment with the hole in stud 80 when members 80, 84 are telescopically engaged. A keeper pin 90 is passed through the selected hole 86 and the single stud hole 81. An enlarged foot 88 is fixed to the bottom of second member 84 for engagement with the toilet seat cover 78, FIG. 1. When member 26 is in the position of FIG. 2, the support means 76 is removed from hole 82. Keeper pin 90 may be chained as at 92 to tubular member 84.

In Use

In use, the user would strap invention 10 over toilet cover 14 using strap 66 which would be passed through the recess 24 and around the toilet tank as shown in FIGS. 1 and 2. The invention 10 may then be placed in the second operational position as shown in FIG. 1, wherein the second member 26 is swung to its second operational position and the support means 76 is placed between the second member 26 and the seat cover, when the seat cover is in the closed downward position, as shown in FIG. 1. The expandable side walls 48 may then be opened for additional support space. A user may then change the diaper of a body or fold clothes or, in other ways, utilize the increased spacial capacity of the invention for efficient utilization of the narrow and confined space of a bathroom.

While the instant invention has been shown and described herein in what is conceived to be the most practical and preferred embodiment, it is recognized that departures may be made therefrom within the scope of the invention, which is therefore not to be limited to the details disclosed herein but is to be accorded the full scope of the claims so as to embrace any and all equivalent apparatus and articles.

What is claimed:

1. A bathroom space expander for adaption to a conventional toilet tank having a cover, comprising;

a first member defining a generally rectangular surface sized and shaped to fit compatibly with the toilet tank cover, the first member having a main generally rectangular surface with top and bottom surfaces and front, side and rear edges, a second member swingable in relation to the first member, defining a generally rectangular surface approximately equal to but slightly greater than first member's main surface, the second member having a top and bottom surfaces with a front edge and overhanging side and rear edges defining overhanging side and rear walls, means for swingably connecting the members to a first closed stored position and a second operational position, means for supporting the second member in the operational position, means for securely but removably connecting the first member to the toilet tank cover;

said side edges each comprising an expandable side having a predetermined length and including a pair of inwardly extending elongated longitudinal members having a first portion within the second member main surface and including an upwardly extending top means, and a second exposed portion outside the main surface having a second end fixed connected to the side edge and, the second member having a pair of longitudinally extending recesses adapted for slidable connection with the side elongated members and the recess having an upper open space sized and adapted for limiting slidable connection with the stop means to allow for limited slidable movement of the expandable side with respect to the second member.

2. The device as set forth in claim 1 wherein at least one of the side edges of the second member comprises an expandable side, and wherein the second member main surface includes stop means for limiting extention of the side edge.

3. The device as set forth in claim 1 wherein the means for securely fastening the first member to the toilet tank comprises the first member top surface having a recess centrally located between the front and rear edges, and a strap means with locking means extending the length of the recess and wrapped around the toilet tank in a vertical plane.

4. The device as set forth in claim 3 wherein the means for supporting the second member in the second operational position comprises:

a second member bottom surface with a recess centrally formed therethrough, a first tubular member having a predetermined length including a first end for reception in said recess and including a single diametric through hole between said first end and a second end; a second tubular member having a plurality of spaced apart through holes along a main central length thereof, and keeper means for selective engagement through any one of said plurality of holes in said second tubular member and said single hole in said first tubular member.

5. The device as set forth in claim 4 wherein the toilet includes a closed seat cover and said second tubular member includes a terminal end defining an enlarged foot resting upon the toilet seat cover.

6. The device as set forth in claim 1 wherein each side edge is approximately equal to the distance between the second member front and rear edges.

* * * * *